US006568068B1

(12) United States Patent
Golan et al.

(10) Patent No.: US 6,568,068 B1
(45) Date of Patent: May 27, 2003

(54) FABRICATION OF PTC HEATING DEVICES

(75) Inventors: Gad Golan, Hod Hasharon (IL); Yuly Galperin, Holon (IL)

(73) Assignee: A.T.C.T. Advanced Thermal Chips Technologies Ltd., Tel Aviv (IL)

( * ) Notice: Subject to any disclaimer, the term of this patent is extended or adjusted under 35 U.S.C. 154(b) by 0 days.

(21) Appl. No.: 09/486,748

(22) PCT Filed: Aug. 31, 1998

(86) PCT No.: PCT/IL98/00422

§ 371 (c)(1),
(2), (4) Date: May 4, 2000

(87) PCT Pub. No.: WO99/12391

PCT Pub. Date: Mar. 11, 1999

(Under 37 CFR 1.47)

(30) Foreign Application Priority Data

Sep. 3, 1997 (IL) ..... 121703

(51) Int. Cl.[7] ..... H01C 29/612

(52) U.S. Cl. ..... 29/612; 29/611; 29/619; 29/620; 29/621; 219/121.46; 219/121.83; 219/483; 219/505; 338/99; 338/114

(58) Field of Search ..... 29/610.1, 611, 29/612, 619, 620, 621, 683, 682, 629, 746; 219/484, 504, 483, 486, 505, 121.69, 121.83, 121.45, 496, 532; 338/114, 99

(56) References Cited

U.S. PATENT DOCUMENTS 3,976,854 A * 8/1976 Ishikawa et al. ..... 219/448.17
4,356,379 A 10/1982 Graeme ..... 229/209
5,077,889 A * 1/1992 Matsuda et al. ..... 228/180.1
5,326,418 A 7/1994 Yeh ..... 156/291
5,382,938 A * 1/1995 Hansson et al. ..... 338/114
5,658,479 A 8/1997 Tadokoro ..... 219/505
4,716,279 A 12/1997 Hori et al. ..... 219/541
5,710,459 A * 1/1998 Teng et al. ..... 257/704

* cited by examiner

*Primary Examiner*—Peter Vo
*Assistant Examiner*—Donghai D Nguyen
(74) *Attorney, Agent, or Firm*—G. E. Ehrlich Ltd.

(57) ABSTRACT

A method and system for fabricating electrical heating devices employing positive temperature coefficient (PTC) thermistor as heating elements which includes: assembling the heating devices with PTC thermistor heating elements preselected according to electrical resistance, applying pressure across the interface between the PTC heating elements and the radiator plates of the heating devices during their assembly, and exposing the heating devices for extended periods of time to both ambient and operational temperatures. The method of fabrication further includes continuously monitoring the electrical resistance of the heating devices and holding their electrical resistance stable by adjusting the pressure applied across the interface between the PTC heating elements and the radiator plates. The system includes a constant temperature chamber for controlling the temperature environment of the heating devices, an ohm-meter circuit for monitoring their electrical resistance, and an adjustable clamping device for adjusting the pressure across the interface between the thermistor heating elements and the radiators of the heating devices.

17 Claims, 3 Drawing Sheets

FABRICATION OF PTC HEATING DEVICES

This application is a continuation of a 371 of PCT/IL98/00422, filed on Aug. 31, 1998.

FIELD OF THE INVENTION

The present invention relates to the manufacture of electrical heating devices, particularly those employing thermistors with positive temperature coefficient of resistance (PTC) as heating elements.

BACKGROUND OF THE INVENTION

Positive temperature coefficient (PTC) heating elements, such as thermistors, are used in electrical heating devices, such as electrical radiators, electrical heating fans, and air conditioner heaters. They have an advantage over electric wire heaters in that they are self-regulating as to temperature and thus are not subject to overheating even in response to abnormal electric currents. As with all heating devices, they must operate at elevated temperatures and must tolerate transitions between ambient and operating temperatures. As is known in the art, this thermal cycling introduces mechanical and other strains to such devices that can cause them to operate at reduced efficiency and can shorten their lifetime.

Prior art has attempted to address these problems by means of design of the heating elements. U.S. Pat. No. 4,954,692, which discloses a PTC thermistor heating device employing a type of spring to introduce pressure on the interface between the PTC thermistors and the radiators of the device, is typical of one approach. The thermal cycling that the device experiences in normal use still applies pressure variation on the PTC thermistors and their interface with the radiators which causes varying resistance, reduced efficiency, and shortened lifetime of the PTC elements and of the entire device. Another known approach is to introduce a thermally and possibly electrically conducting adhesive to the interface, as in U.S. Pat. No. 5,358,793. Devices employing adhesives fabricated according to known methods only partially alleviate the abovementioned problems and are subject to micro-fissuring in the adhesive layer and to interface breakdown when exposed to thermal cycling.

SUMMARY OF THE INVENTION

The present invention seeks to overcome the disadvantages of known art in positive temperature coefficient (PTC) thermistor electrical heating devices by providing an improved method for their fabrication. The method includes steps of pre-exposing the devices to operational temperatures while monitoring the electrical resistance of the devices and maintaining the stability thereof by adjusting the pressure across the interface between the thermistor heating elements and the radiators of the heating devices. Use of this method produces PTC thermistor electrical heating devices with an extended useful life compared to those produced according to known art.

The present invention further seeks to provide a system for fabricating positive temperature coefficient (PTC) thermistor electrical heating devices according to the abovementioned method.

There is thus provided, in accordance with a preferred embodiment of the invention, a method of fabricating positive temperature coefficient (PTC) thermistor electrical heating devices which includes: assembling the heating devices with PTC thermistor heating elements preselected according to electrical resistance, applying pressure across the interface between the PTC heating elements and the radiator plates of the heating devices during their assembly, and exposing the heating devices for extended periods of time to both ambient and operational temperatures. A further feature of the present method of fabrication is ensuring that any temperature changes are very gradual. The present method of fabrication further includes continuously monitoring the electrical resistance of the heating devices and holding their electrical resistance stable by adjusting the pressure applied across the interface between the PTC heating elements and the radiator plates.

There is further provided, in accordance with a preferred embodiment of the present invention, a system for performing the abovementioned fabrication method which includes a constant temperature chamber for controlling the temperature environment of the heating devices, an ohm-meter circuit for monitoring their electrical resistance, and an adjustable clamping device for adjusting the pressure across the interface between the thermistor heating elements and the radiators of the heating devices.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
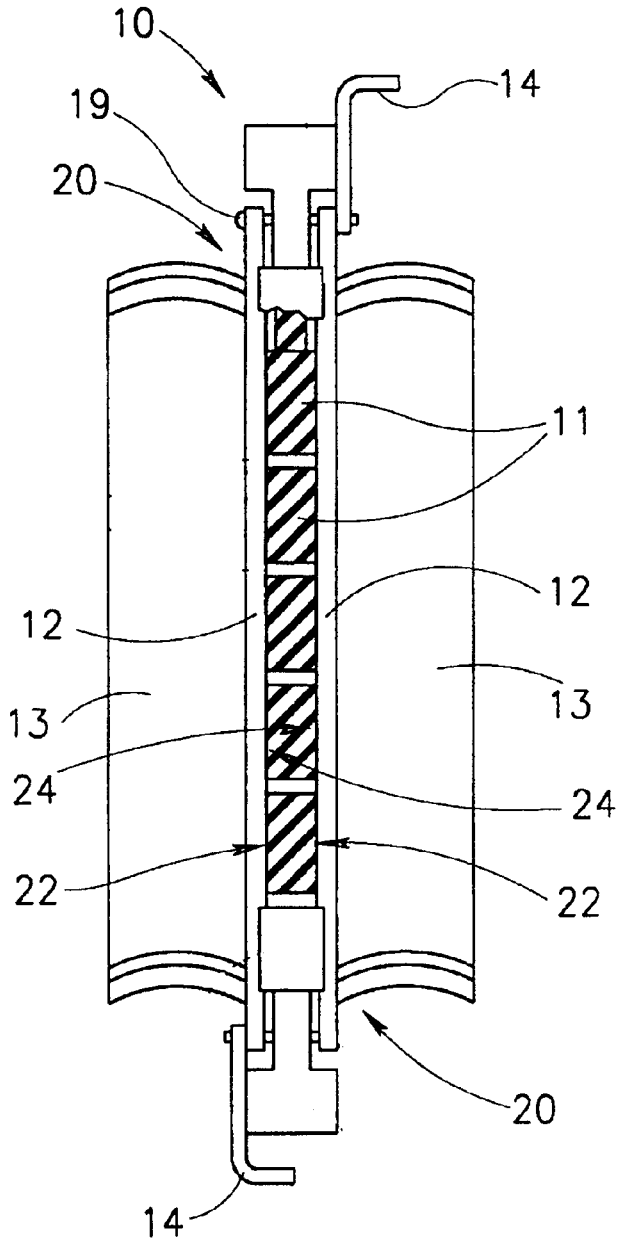
FIG. 1 is a schematic side-sectional view of an electrical heating device typical of those fabricated in accordance with a preferred embodiment of the present invention.

Referring now to FIG. 1, there is shown, by way of example, an electrical heating device referred to generally as 10, typical of those fabricated in accordance with a preferred embodiment of the present invention. Electrical heating device 10 has an array of one or more heating elements 11, which are positive temperature coefficient (PTC) thermistors. They are fabricated with preferably parallel, generally flat, surfaces on opposing faces 22, which are coated with a conductive metal such as aluminum, to serve as thermal and electrical contact surfaces. On opposing sides of heating elements 11 are heat radiator units, referred to generally as 20, each of which includes a plate 12 and cooling fins 13 extending generally transversely therefrom. Radiator units 20 are made of material that is a good thermal and electrical conductor, such as aluminum. The plates 12 of the radiator units 20 are fabricated with flat inward-facing surfaces 24 to serve as thermal and electrical contact surfaces. The plates 12 are positioned so that the inward-facing contact surfaces are generally parallel to and in touching contact with the outward-facing contact surfaces of the heating elements 11 so as to define thermal and electrical interfaces therewith. The conduction across the interfaces may optionally be improved by the use of a thermally and electrically conductive adhesive thereat. Attached to the plates 12 are electrodes 14 which allow the heating device 10 to be connected to an electrical circuit to provide electric power thereto or to measure the electrical resistance thereof.

Figure 2:
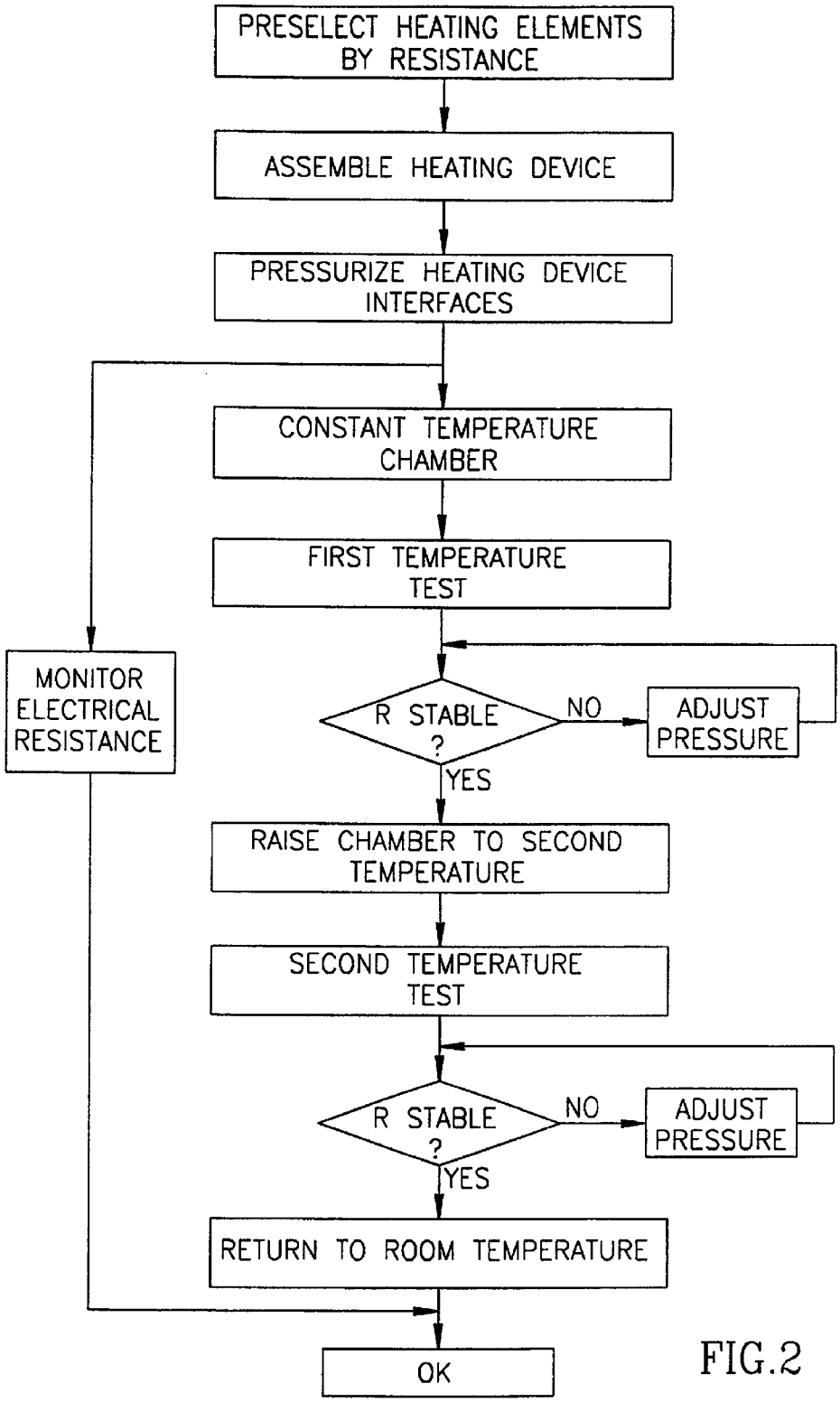
FIG. 2 is a flow chart of steps in fabricating an electrical heating device in accordance with the method of the present invention.
Figure 3:
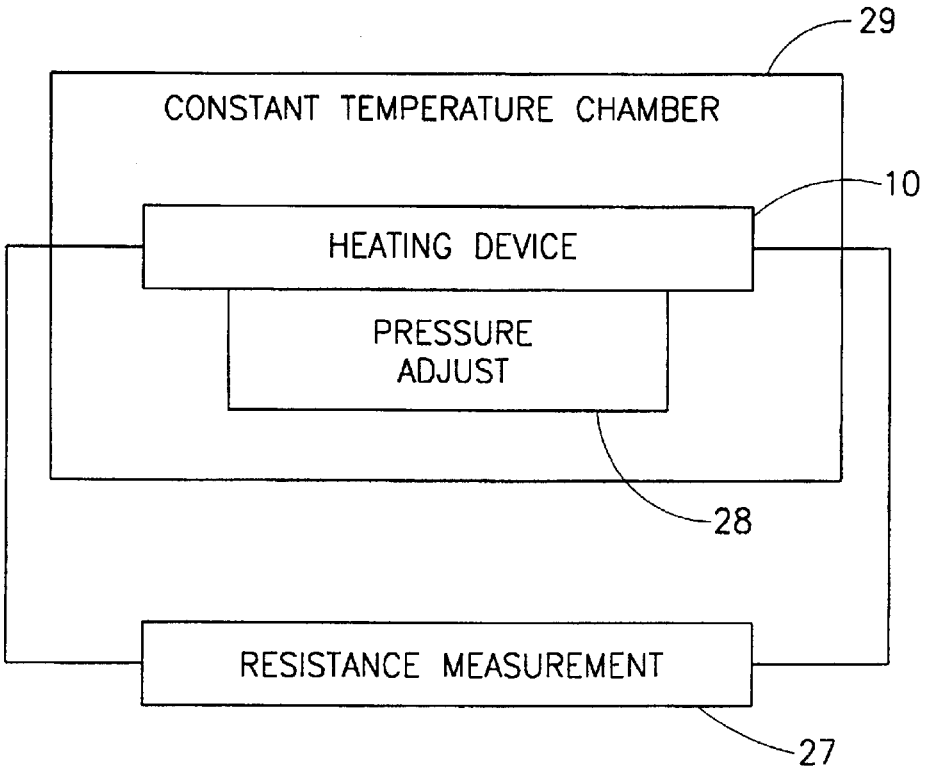
FIG. 3 is a schematic block diagram of a system for fabricating an electrical heating device in accordance with a preferred embodiment of the present invention.

A method for fabricating a PTC thermistor electrical heating device in accordance with a preferred embodiment of the present invention is shown schematically in the flow chart in FIG. 2, and a system for fabricating a PTC thermistor electrical heating device in accordance with a preferred embodiment of the present invention is shown schematically in the block diagram in FIG. 3.

Referring now to FIG. 3, there is shown a schematic block diagram of a system for fabricating a PTC thermistor electrical heating device in accordance with a preferred embodiment of the present invention. Heating device 10 is connected in an electrical circuit with an ohm-meter 27 to measure its electrical resistance. There is also an adjustable clamping mechanism 28 to adjust the pressure on the thermal and electrical interfaces between heating elements 11 and radiator plates 12 of heating device 10 (FIG. 1). Heating device 10, together with pressure adjustment clamping mechanism 28, while connected to ohm-meter 27, are enclosed in chamber 29 to provide a constant temperature environment in order to expose heating device 10 to thermal cycling with gradual temperature changes in accordance with a preferred embodiment of the present invention.

The method shown in FIG. 2 includes the following steps wherein numbered components of the heating device which are referenced can be seen in FIG. 1 and the numbered elements of the fabrication system which are referenced can be seen in FIG. 3:

preselecting the PTC thermistor heating elements 11 for the heating device so that they all have an electrical resistance within a 25% range around a desired nominal value assembling the heating device 10 by arranging the PTC thermistor heating elements 11 in an array and enclosing them between radiator plates 12, optionally applying a thermally and electrically conducting adhesive to the interface 22 and 24 between the PTC heating elements 11 and the radiator plates 12, and by installing an adjustable clamping mechanism around the device on the radiator plates 12 for applying pressure on the interface 22 and 24 thereby continuously monitoring the electrical resistance of the heating device 10 by attaching an ohm-meter 27 (FIG. 3) to the heating device electrodes 14 placing the heating device 10 with the ohm-meter 27 connected in a temperature-controlled chamber 29 (FIG. 3)

holding the heating device 10 at a temperature of 15–25° C. for 16 hours while monitoring the electrical resistance during first constant-temperature test, if the electrical resistance chances by more than 15–20%, adjusting the pressure across the interface in the heating device to cause the electrical resistance of the heating device to return to its original value gradually, at a rate of no more than 40° C./hr, heating the temperature-controlled chamber 29 (FIG. 3) up to 250° C.

holding the heating device 10 at a temperature of 240–290° C. for 8 hours while monitoring the electrical resistance during second constant-temperature test, if the electrical resistance changes by more than 15–20%, adjusting the pressure across the interface in the heating device to cause the electrical resistance of the heating device to return to its original value gradually, at a rate of no more than 40° C./hr, cooling the temperature-controlled chamber 29 (FIG. 3) to ambient temperature It will further be appreciated, by persons skilled in the art that the scope of the present invention is not limited by what has been specifically shown and described hereinabove, merely by way of example. Rather, the scope of the present invention is defined solely by the claims, which follow.

What is claimed is:

1. A method of fabricating a positive temperature coefficient (PTC) thermistor electrical heating device, comprising the steps of:

assembling a PTC electrical heating device by enclosing one or more planar PTC heating elements having generally parallel, flat, contact surfaces between generally parallel, flat, contact surfaces of a pair of radiator members, thereby defining contact interfaces between the contact surfaces of the heating elements and the contact surfaces of the radiator members;

applying a pressure across the interfaces;

measuring the electrical resistance across the heating device;

exposing the heating device to a first temperature for a first predetermined time period;

determining whether a change occurs in the electrical resistance across the heating device when exposed to the first temperature during said first predetermined time period;

exposing the heating device to a second temperature for a second predetermined time period;

determining whether a change occurs in the electrical resistance across the heating device when exposed to the second temperature during said second predetermined time period; and during said steps of determining, in the event that the electrical resistance across the heating device is determined to have changed by more than a predetermined amount during one of said predetermined time periods, adjusting the pressure across the interfaces in the respective time period, thereby to stabilize the electrical resistance across the heating device in the respective time period.

2. A method according to claim 1 wherein said step of assembling, for a heating device comprising a plurality of PTC heating elements, further comprises the sub-step of preselecting the heating elements based on their measured electrical resistance.

3. A method according to claim 2 wherein said sub-step of preselecting further comprises preselecting the heating elements so that all the heating elements within one heating device have a measured electrical resistance within a twenty-five percent range of one another.

4. A method according to claim 1 which further comprises, as a sub-step of the step of exposing the heating device to a second temperature, the step of ensuring that the rate of change of temperature between exposing the heating device to a first temperature and exposing the heating device to a second temperature is no greater than a predetermined rate.

5. A method according to claim 4 wherein the rate of change of temperature is no greater than forty degrees Celsius per hour.

6. A method according to claim 1 wherein said step of exposing the heating device to a second temperature comprises exposing the heating device to a temperature that is greater than the first temperature.

7. A method according to claim 1 wherein each of said steps of determining further comprises continuously measuring the electrical resistance across the heating device during said steps of exposing and of determining.

8. A method according to claim 1 wherein said step of assembling further comprises the sub-step of applying an adhesive which is electrically and thermally conductive to the contact surfaces of the heating elements and the contact surfaces of the radiator members prior to said step of applying a pressure.

9. A method according to claim 1 wherein said step of exposing the heating device to a first temperature comprises exposing the heating device to a temperature in the range of fifteen to twenty-five degrees Celsius.

10. A method according to claim 1 wherein said step of exposing the heating device to a second temperature comprises exposing the heating device to the temperature of the heating elements when the heating device is in operation.

11. A method according to claim 1 wherein said step of exposing the heating device to a second temperature comprises exposing the heating device to a temperature in the range of 240–290 degrees Celsius.

12. A method according to claim 1 wherein said step of exposing the heating device to a first temperature for a first predetermined time period comprises exposing the heating device to a first temperature for a time period no less than sixteen hours.

13. A method according to claim 1 wherein said step of exposing the heating device to a second temperature for a second predetermined time period comprises exposing the heating device to a second temperature for a time period no less than eight hours.

14. A method according to claim 1 wherein said steps of applying a pressure and adjusting the pressure comprise adjusting threaded fasteners extending transversely through the device.

15. A system for fabricating a positive temperature coefficient (PTC) thermistor electrical heating device having one or more planar PTC heating elements enclosed by a pair of radiator members and wherein the heating elements have generally parallel, flat, contact surfaces which are between generally parallel, flat, contact surfaces of a pair of radiator members, thereby defining contact interfaces between the contact surfaces of the heating elements and the contact surfaces of the radiator members, the system comprising:

an adjustable clamping mechanism applied to said heating device for setting and adjusting a pressure across the contact interfaces of the heating device;

resistance measurement means connected to said heating device for measuring the electrical resistance across the heating device; and temperature control means for exposing the heating device, while connected to said resistance measurement means and clamped by said adjustable clamping mechanism, to a plurality of predetermined temperatures for predetermined periods of time to enable measuring the electrical resistance across the heating device at each such predetermined temperature, and to enable making any necessary adjustments to said adjustable clamping mechanism to maintain the electrical resistance of the heating device within a predetermined range, while ensuring that the rate of change of temperature when exposing the heating device to different predetermined temperatures is no greater than a predetermined rate.

16. A system according to claim 15 wherein said adjustable clamping mechanism is arranged in touching contact with the radiation members of the heating device for exerting a pressure on the contact interfaces of the heating device via the radiator members.

17. A system according to claim 15 wherein said temperature control means comprises a temperature controlled chamber which encloses the heating device while clamped by said adjustable clamping mechanism, and while connected to said resistance measurement means.

* * * * *